US006245725B1

(12) United States Patent
Tanaka et al.

(10) Patent No.: US 6,245,725 B1
(45) Date of Patent: Jun. 12, 2001

(54) LUBRICATING COMPOSITIONS

(75) Inventors: Noriyoshi Tanaka; Yukio Tatsumi; Yoko Saito; Atsuo Miyashita, all of Tokyo (JP)

(73) Assignee: Asahi Denka Kogyo K.K., Tokyo (JP)

( * ) Notice: Subject to any disclaimer, the term of this patent is extended or adjusted under 35 U.S.C. 154(b) by 0 days.

(21) Appl. No.: 09/468,226

(22) Filed: Dec. 20, 1999

(30) Foreign Application Priority Data

Dec. 24, 1998 (JP) ..... 10-366976

(51) Int. Cl.[7] ..... C10M 135/18
(52) U.S. Cl. ..... 508/365; 508/363; 508/364
(58) Field of Search ..... 508/363, 364, 508/365

(56) References Cited

U.S. PATENT DOCUMENTS

| | | | | |
|---|---|---|---|---|
| 5,356,547 | * | 10/1994 | Arai et al. | 508/363 |
| 5,494,608 | * | 2/1996 | Kamakura et al. | 508/363 |
| 5,627,146 | * | 5/1997 | Tanaka et al. | 508/363 |
| 5,672,572 | * | 9/1997 | Arai et al. | 508/364 |
| 5,688,748 | * | 11/1997 | Tomizawa | 508/363 |
| 5,696,065 | * | 12/1997 | Tanaka et al. | 508/465 |
| 5,786,307 | * | 7/1998 | Igarashi et al. | 508/365 |
| 5,858,931 | * | 1/1999 | Tanaka et al. | 508/364 |
| 5,916,851 | * | 6/1999 | Hosonuma et al. | 508/363 |

* cited by examiner

*Primary Examiner*—Ellen M. McAvoy
(74) *Attorney, Agent, or Firm*—Sughrue, Mion, Zinn, Macpeak & Seas, PLLC

(57) ABSTRACT

There is provided a lubricating composition including a lubricating base containing an asymmetric sulfurized oxymolybdenum dithiocarbamate of the formula (1); a symmetric sulfurized oxymolybdenum dithiocarbamate of the formula (2); and a phenolic or aminic antioxidant.

(1)

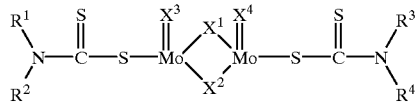

(2)

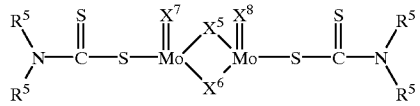

(wherein $R^1$ to $R^5$ are each a hydrocarbon group, provided that $R^1$ to $R^4$ are not concurrently the same group; and $X^1$ to $X^8$ are each a sulfur atom or an oxygen atom.)

This lubricating composition meets both the required solubility of additives in base oils and long drain properties concurrently.

5 Claims, No Drawings

LUBRICATING COMPOSITIONS

BACKGROUND OF THE INVENTION

1. Field of the Invention

The present invention relates to a lubricating composition.

2. Description of the Related Art

The present conditions sorrounding automobiles consist of tighter and tighter fuel efficiency standards, auto-emission standards, etc. This has arisen because of concerns about global warming, air pollution, acid rain and other environmental issues, and resource conservation out of fears about depletion of limited petroleum energy. The most effective solution to those problems at present is improvement in fuel efficiency.

Key elements for improving the fuel efficiency of automobiles are improvements in engine oils such as viscosity reduction and addition of superior friction modifiers to prevent frictional losses, and improvements in automobiles themselves such as weight reduction and engine improvements. Engine oils serve as lubricants between pistons and liners, in which area fluid friction predominantly occurs, and viscosity reduction in engine oils can reduce frictional losses. Accordingly, the viscosity of engine oils has been further reduced in recent years, but this invites new problems such as reduced sealing properties and increased abrasion loss. Engine oils also play important roles in lubricating moving valve systems and bearings, in which area mixed type lubrication and boundary lubrication predominantly occur, and thus the reduction in viscosity of engine oils causes friction increases. Therefore, friction modifiers, extreme pressure additives and others are added to engine oils in order to reduce frictional losses and to avoid abrasion arising from reduced viscosity.

Organo-molybdenum compounds have superior friction reduction activity and are added to a variety of lubricating oils. They are particularly effective in engine oils for improving fuel efficiency, to reduce frictional resistance on individual parts of engines and thereby to save fuel, and have become essential additives for so-called fuel efficient oils. Such fuel efficient oils should not only exhibit superior fuel-saving performance at early stages of their use but also retain that performance for a long time thereafter. Accordingly, there is now strong demand for fuel efficient oils that retain friction reducing performance even after the lubricating oils have deteriorated due to long-term use.

Of the organo-molybdenum compounds having excellent fuel saving effects, sulfurized oxymolybdenum dialkyldithiocarbamate have drawn special attention. These compounds have long been known as lubricants. For example, Japanese Patent Publication No. 53-31646 describes the use of an sulfurized oxymolybdenum dialkyldithiocarbamate as a lubricant, which compound contains alkyl groups each having 1 to 24 carbon atoms and sulfur and oxygen atoms in specific proportions. Separately, Japanese Patent Publication No. 6-47675 discloses an sulfurized oxymolybdenum dialkyldithiocarbamate where alkyl groups are asymmetric, which is an example of an sulfurized oxymolybdenum dialkyldithiocarbamate having improved solubility in base oils.

Japanese Patent Application Laid-open No. 8-176779 discloses that the aforementioned alkyl-group-asymmetric sulfurized oxymolybdenum dialkyldithiocarbamate has superior solubility also in high viscosity index oil (high VI oil) in which lubricating oil additives have low solubility.

Recent studies, however, have revealed that such alkyl-group-asymmetric oxymolybdenum dialkyldithiocarbamate sulfides are somewhat poor in so-called long drain properties, properties that exhibit superior friction reducing effect even after deterioration of the lubricating oils, although they are superior in base oil solubility.

Accordingly, after intensive investigation, the present inventors have developed a lubricating composition which is superior both in additive solubility in lubricating bases and in long drain properties by the combined use of specific organo-molybdenum compounds and a specific antioxidant.

SUMMARY OF THE INVENTION

The present invention provides a lubricating composition including a lubricating base containing Component (A1): an asymmetric sulfurized oxymolybdenum dithiocarbamate represented by the following formula (1)

(1)

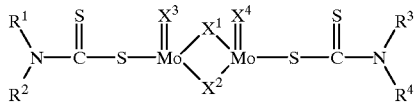

(wherein $R^1$ to $R^4$ are each a hydrocarbon group, provided that all of $R^1$ to $R^4$ are not concurrently the same group; and $X^1$ to $X^4$ are each a sulfur atom or an oxygen atom);

Component (A2): a symmetric sulfurized oxymolybdenum dithiocarbamate represented by the following formula (2)

(2)

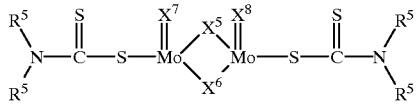

(wherein $R^5$ is a hydrocarbon group, and $X^5$ to $X^8$ are each a sulfur atom or an oxygen atom); and (B) a phenolic antioxidant or an aminic antioxidant.

DETAILED DESCRIPTION OF THE INVENTION

The combined use of specific organo-molybdenum compounds along with the use of a specific antioxidant can give a lubricating composition which has superior solubility in lubricating bases, in particular in high VI oils and exhibits superior friction reducing effects even in lubricating oils deteriorated by long-term use and hence has superior long drain properties.

Component (A1)

The component (A1) of the lubricating composition of the present invention is an asymmetric sulfurized oxymolybdenum dithiocarbamate represented by the formula (1). In the formula (1), $R^1$ to $R^4$ are each a hydrocarbon group, provided that all of $R^1$ to $R^4$ are not concurrently the same hydrocarbon group. It is especially preferable that $R^1$ and $R^2$ are both the same hydrocarbon group, and $R^3$ and $R^4$ are both the same hydrocarbon group, and $R^1$ and $R^3$ are both different hydrocarbon groups. Such asymmetric sulfurized oxymolybdenum dithiocarbamates represented by the formula (1) are superior in solubility or dispersibility in the lubricating base and are advantageous when comparatively large amounts of sulfurized oxymolybdenum dithiocarbamates are compounded into lubricating bases.

Hydrocarbon groups represented by $R^1$ to $R^4$ include, but are not limited to, alkyl groups, alkenyl groups, aryl groups, cycloalkyl groups and cycloalkenyl groups.

Examples of the alkyl groups include methyl, ethyl, propyl, isopropyl, butyl, isobutyl, secondary butyl, tertiary butyl, pentyl, isopentyl, secondary pentyl, neopentyl, tertiary pentyl, hexyl, secondary hexyl, heptyl, secondary heptyl, octyl, 2-ethylhexyl, secondary octyl, nonyl, secondary nonyl, decyl, secondary decyl, undecyl, secondary undecyl, dodecyl, secondary dodecyl, tridecyl, isotridecyl, secondary tridecyl, tetradecyl, secondary tetradecyl, hexadecyl, secondary hexadecyl, stearyl, icosyl, docosyl, tetracosyl, triacontyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, monomethyl branched-isostearyl and the like.

The alkenyl groups include, but are not limited to, vinyl, allyl, propenyl, butenyl, isobutenyl, pentenyl, isopentenyl, hexenyl, heptenyl, octenyl, nonenyl, decenyl, undecenyl, dodecenyl, tetradecenyl, oleyl and the like.

As the aryl groups, there may be mentioned, for instance, phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, phenylphenyl, benzylphenyl, styrenated phenyl, p-cumylphenyl, α-naphthyl, β-naphthyl groups and the like.

The cycloalkyl groups and cycloalkenyl groups include, but are not limited to, cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl, methylcycloheptenyl groups and the like.

Of these groups, the alkyl groups or alkenyl groups are preferred as $R^1$ to $R^4$. More preferably, $R^1$ and $R^2$ are each an alkyl group having 6 to 10 carbon atoms, and $R^3$ and $R^4$ are each an alkyl group having 11 to 18 carbon atoms, and most preferably, $R^1$ and $R^2$ are each a branched alkyl group having 6 to 10 carbon atoms, and $R^3$ and $R^4$ are each a branched alkyl group having 11 to 18 carbon atoms.

Component (A2)

The component (A2) of the lubricating composition of the present invention is a symmetric sulfurized oxymolybdenum dithiocarbamate represented by the formula (2). In the formula (2), $R^5$ is a hydrocarbon group. In other words, the symmetric sulfurized oxymolybdenum (dialkyl) dithiocarbamate represented by the formula (2) has four identical hydrocarbon groups.

As $R^5$, groups similar to the hydrocarbon groups described regarding $R^1$ to $R^4$ can be exemplified. The substituent $R^5$ is preferably an alkyl group or an alkenyl group, more preferably an alkyl group having 4 to 18 carbon atoms, and most preferably a branched alkyl group having 6 to 13 carbon atoms.

In the formulae (1) and (2), $X^1$ to $X^4$ and $X^5$ to $X^8$ are each a sulfur atom or an oxygen atom, and all of $X^1$ to $X^4$ and $X^5$ to $X^8$ may be a sulfur atom or an oxygen atom, or four $X^1$ to $X^4$, or $X^5$ to $X^8$ may each be a mixture of a sulfur atom or an oxygen atom. In consideration of balance between friction reducing effect and corrosivity, the molar ratio (ratio of numbers) of sulfuric atom(s)/oxygen atom(s) should particularly preferably be in the range from 1/3 to 3/1, for each of the formulae (1) and (2).

The compositional ratio of the components (A1) and (A2) is not especially limited, but it is preferably such that (A1)/(A2)=1/99 to 99/1, more preferably 5/95 to 80/20, and most preferably 10/90 to 70/30, in terms of the weight ratio of molybdenum atoms in consideration of the solubility or dispersibility in the lubricating base and the long drain property.

The amounts of the components (A1) and (A2) are not particularly limited, but if the amounts are excessively small, the friction reducing effect is insufficient, on the contrary, if they are excessively large, sludge or corrosion is liable to occur. Sulfurized oxymolybdenum dithiocarbamates are believed to exhibit abrasion resistance effects when the amounts are comparatively low, i.e., about 0.03% by weight or less in terms of molybdenum relative to the lubricating base, and to exhibit remarkable friction reducing effect when the amounts are comparatively large. Accordingly, the total proportion of the components (A1) and (A2) should preferably fall in the range from 0.001 to 3% by weight, more preferably from 0.005 to 2% by weight, and particularly preferably from 0.01 to 1% by weight in terms of molybdenum relative to the weight of the lubricating base.

The asymmetric sulfurized oxymolybdenum dithiocarbamates represented by the formula (1) can be prepared according to, for example, a process described in Japanese Patent Application Laid-open No. 62-81396. To be more specific, they can be prepared by reacting molybdenum trioxide or a molybdate with an alkali sulfide or an alkali hydrosulfide, and subsequently adding carbon disulfide and a secondary amine to the reaction mixture and reacting the resultant mixture at an adequate temperature. To prepare the asymmetric sulfurized oxymolybdenum dithiocarbamates, the use of a secondary amine having different hydrocarbon groups or the use of two or more different secondary amines in the above process is sufficient. The symmetric sulfurized oxymolybdenum dithiocarbamates can also be prepared in a similar manner, by the use of only one secondary amine.

Component (B)

The component (B) of the inventive lubricating composition is a phenolic antioxidant or an aminic antioxidant. As such phenolic antioxidants, hindered phenolic antioxidants having a tertiary butyl group or a tertiary pentyl group in the molecule are typically preferred. Such compounds include, but are not limited to, 2,6-di-tert.-butylphenol, 2,6-di-tert.-butyl-p-cresol, 2,6-di-tert.-butyl-4-methylphenol, 2,6-di-tert.-butyl-4-ethylphenol, 2,4-dimethyl-6-tert.-butylphenol, 4,4'-methylenebis(2,6-di-tert.-butylphenol), 4,4'-bis(2,6-di-tert.-butylphenol), 4,4'-bis(2-methyl-6-tert.-butylphenol), 2,2'-methylenebis(4-methyl-6-tert.-butylphenol), 2,2'-methylenebis(4-ethyl-6-tert.-butylphenol), 4,4'-butylidenebis(3-methyl-6-tert.-butylphenol), 4,4'-isopropylidenebis(2, 6-di-tert.-butylphenol), 2,2'-methylenebis(4-methyl-6-cyclohexylphenol), 2,2'-methylenebis(4-methyl-6-nonylphenol), 2,2'-isobutylidenebis(4,6-dimethylphenol), 2,6-bis(2'-hydroxy-3'-tert.-butyl-5'-methylbenzyl)4-methylphenol, 3-tert.-butyl-4-hydroxyanisole, 2-tert.-butyl-4-hydroxyanisole, stearyl 3-(4-hydroxy-3,5-di-tert.-butylphenyl)propionate, oleyl 3-(4-hydroxy-3,5-di-tert.-butylphenyl)propionate, dodecyl 3-(4-hydroxy-3,5-di-tert.-butylphenyl)propionate, decyl 3-(4 -hydroxy-3,5-di-tert.-butylphenyl)propionate, octyl 3-(4-hydroxy-3,5-di-tert.-butylphenyl)propionate, 3-(4-hydroxy-3,5-di-tert.-butylphenyl)propionic acid pentaerythritol tetraester, 3-(4-hydroxy-3,5-di-tert.-butylphenyl)propionic acid glycerol monoester, ester of 3-(4-hydroxy-3,5-di-tert.-butylphenyl)propionic acid and glycerol monooleyl ether, 3-(4-hydroxy-3,5-di-tert.-butylphenyl)propionic acid butylene glycol ester, 3-(4-hydroxy-3,5-di-tert.-butylphenyl)propionic acid thiodiglycol ester, 4,4'-thiobis(3-methyl-6-tert.-butylphenol), 4,4'-thiobis(2-methyl-6-tert.-butylphenol), 2,2'-thiobis(4-methyl-6-tert.-butylphenol), 2,6-di-tert.-butyl-α-dimethylamino-p-cresol, 2,6-di-tert.-butyl-4-(N,N'- dimethylaminomethylphenol), bis(3,5-di-tert.-butyl-4-hydroxybenzyl) sulfide, tris{(3,5-di-tert.-butyl-4-hydroxyphenyl)propionyl-oxyethyl} isocyanurate, tris(3,5-di-tert.-butyl-4-hydroxyphenyl) isocyanurate, bis{2-methyl-4-(3-n-alkylthiopropionyloxy)-5-tert.-butylphenyl} sulfide, 1,3,5-tris(4-di-tert.-butyl-3-hydroxy-2,6-dimethylbenzyl) isocyanurate, tetraphthaloyl-di(2,6-dimethyl-4-tert.-butyl-3-hydroxybenzyl sulfide), 6-(4-hydroxy-3,5-di-tert.-butylanilino)-2,4-bis(octylthio)-1,3,5-triazine, 2,2-thio-{diethyl-bis-3-(3,5-di-tert.-butyl-4-hydroxyphenyl)} propionate, N,N'-hexamethylenebis(3,5-di-tert.-butyl-4-hydroxy-hydrocinnamamide), 3,5-di-tert.-butyl-4-hydroxybenzyl-phosphoric acid diester, bis(3-methyl-4-hydroxy-5-tert.-butylbenzyl) sulfide, alkylated bisphenol A, polyalkylated bisphenol A, as well as:

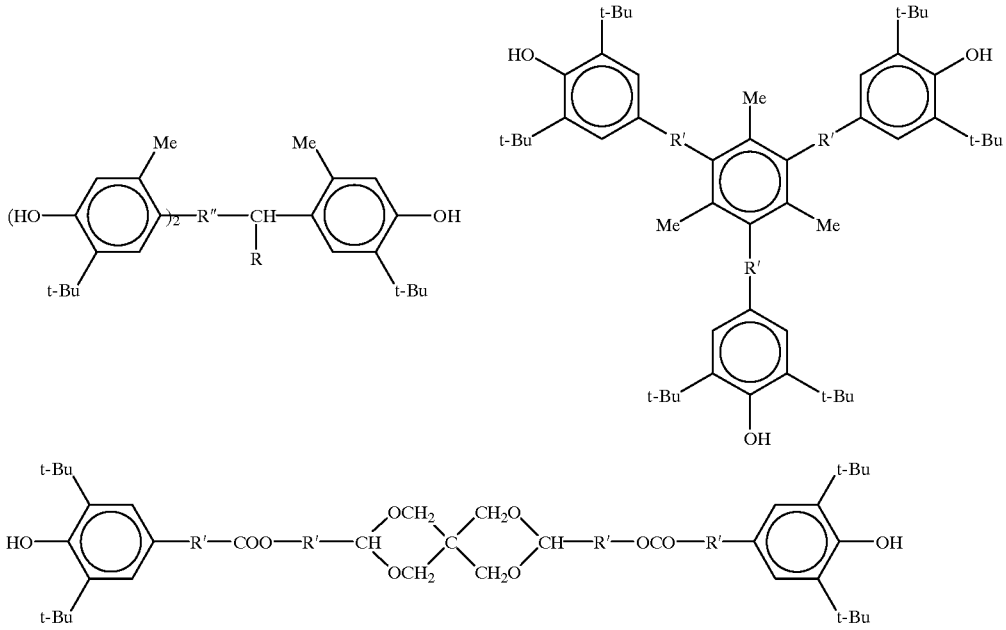

(wherein Me is a methyl group, t-Bu is a tert.-butyl group, R is a monovalent hydrocarbon group, R' is a divalent hydrocarbon group, and R" is a trivalent hydrocarbon group.)

Particularly preferred aminic antioxidants are aromatic aminic antioxidants. Such compounds include, but are not limited to, 1-naphthylamine, phenyl-1-naphthylamine, p-octylphenyl-1-naphthylamine, p-nonylphenyl-1-naphthylamine, p-dodecylphenyl-1-naphthylamine, phenyl-2-naphthylamine, and other naphthylamine-based antioxidants; N,N'-diisopropyl-p-phenylenediamine, N,N-diisobutyl-p-phenylenediamine, N,N'-diphenyl-p-phenylenediamine, N,N'-di-p-naphthyl-p-phenylenediamine, N-phenyl-N'-isopropyl-p-phenylenediamine, N-cyclohexyl-N'-phenyl-p-phenylenediamine, N-1,3-dimethylbutyl-N'-phenyl-p-phenylenediamine, dioctyl-p-phenylenediamine, phenylhexyl-p-phenylenediamine, phenyloctyl-p-phenylenediamine, and other phenylenediamine-based antioxidants; dipyridylamine, diphenylamine, p,p'-di-n-butyldiphenylamine, p,p'-di-tert.-butyldiphenylamine, pp'-di-tert.-pentyldiphenylamine, p,p'-dinonyldiphenylamine, p,p'-didecyldiphenylamine, p,p'-didodecyldiphenylamine, p,p'-distyryldiphenylamine, p,p'-dimethoxydiphenylamine, 4,4'-bis(4-α,α-dimethylbenzoyl)diphenylamine, p-isopropoxydiphenylamine, and other diphenylamine-based antioxidants; phenothiazine, N-methylphenothiazine, N-ethylphenothiazine, 3,7-dioctylphenothiazine, phenothiazine carboxylic acid ester, phenoselenazine, and other phenothiazine-based antioxidants.

The proportion of the component (B) is not particularly limited, but if it is excessively small, sufficient oxidation inhibitory effect cannot be expected, and on the contrary, if it is excessively large, sludge may form. The proportion is therefore preferably 0.001 to 10% by weight, more preferably 0.005 to 5% by weight, and typically preferably 0.01 to 3% by weight relative to the lubricating base.

The lubricating composition of the present invention is featured in the combined use of the asymmetric sulfurized oxymolybdenum dithiocarbamate represented by the formula (1) as the component (A1), which is superior in solubility or dispersibility in the base, with the component (A2), the symmetric sulfurized oxymolybdenum dithiocarbamate represented by the formula (2), and further with the component (B) the phenolic antioxidant or aminic antioxidant. As described above, this configuration can give a lubricating composition in which even large amounts of sulfurized oxymolybdenum dithiocarbamates can be homogeneously dissolved or dispersed and which can yield a sufficient friction reducing effect even after deterioration.

Component (C)

The component (C) of the present invention is a zinc dithiophosphate represented by the following formula (3)

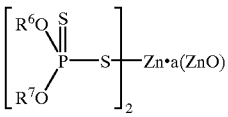

(3)

(wherein $R^6$ and $R^7$ are each a hydrocarbon group, and a denotes a number from 0 to 1/3.).

The incorporation of the component (C) into the lubricating composition of the present invention further improves the oxidation inhibitory properties and long drain properties. In the formula (3), $R^6$ and $R^7$ are each a hydrocarbon group, preferably an alkyl group, an alkenyl group, or an aryl group. Of these groups, alkyl groups each having 3 to 14 carbon atoms are typically preferred. As the component (C), two or more zinc dithiophosphates having mutually different $R^6$ and $R^7$ can be used in combination. The number represented by a is a number from 0 to 1/3. When a 0, the compound is referred to as a neutral zinc dithiophosphate, and when a=1/3, it is referred to as a basic zinc dithiophosphate, which is obtained by reacting zinc oxide in an excess amount of not less than the stoichiometric amount.

The proportion of the component (C) is not especially limited, but a certain proportion is preferably incorporated in order to exhibit a practical friction reducing effect and oxidation inhibitory effect, while on the contrary, an excessively large proportion may cause sludge formation. Accordingly, the proportion should preferably fall in the range from 0.001 to 3% by weight, more preferably from 0.005 to 2% by weight, and typically preferably from 0.01 to 1% by weight, in terms of phosphorus relative to the lubricating base.

Component (D)

The lubricating composition of the present invention may further comprise, as the component (D), any one or more of (D1) a metallic detergent, (D2) an ashless dispersant, (D3) a compound containing phosphorus atoms, (D4) a compound containing phosphorus atoms and sulfur atoms, (D5) a compound containing sulfur atoms and containing no metal atoms, (D6) a sulfurous antioxidant, (D7) an organometallic compound, (D8) an oiliness improver free of any metal atoms, phosphorus atoms and sulfur atoms, (D9) a rust inhibitor, (D10) a viscosity index improver, (D11) a metal deactivator, (D12) an antifoaming agent, (D13) a solid lubricant or the like.

As the metallic detergent, the component (D1), there may be mentioned, for instance, metal sulfonates, metal phenates, metal salicylates, and metal phosphonates. Such metal sulfonates include, but are not limited to, (mono- or di-) alkylnaphthalenesulfonic acid metal salts, petroleum sulfonic acid metal salts, as well as, substituted benzenesulfonic acid metal salts represented by the following formula (D1-1)

(D1-1)

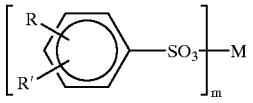

(wherein R and R' are each a chain hydrocarbon group having about 10 to 30 carbon atoms, M is a metal atom, and m denotes the valency of M).

The metal phenates include, but are not limited to, compounds represented by the following formula (D1-2)

(D1-2)

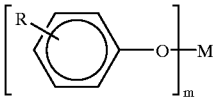

(wherein R is a chain hydrocarbon group having about 3 to 20 carbon atoms, M is a metal atom, and m denotes the valency of M), the following formula (D1-3)

(D1-3)

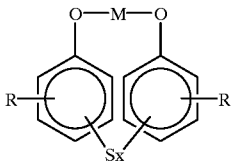

(wherein R is a chain hydrocarbon group having about 3 to 20 carbon atoms, M is a metal atom, and x denotes a number of about 1 to 5, the above formula is, however, a typical example) or the following formula (D1-4)

(D1-4)

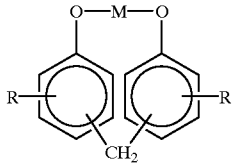

(wherein R is a chain hydrocarbon group having about 3 to 20 carbon atoms, and M is a metal atom, the above formula is, however, a typical example).

The metal salicylates include, but are not limited to, compounds represented by the following formula (D1-5)

(D1-5)

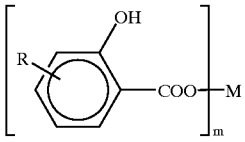

(wherein R is a chain hydrocarbon group having about 3 to 20 carbon atoms, M is a metal atom, and m denotes the valency of M), the following formula (D1-6)

(D1-6)

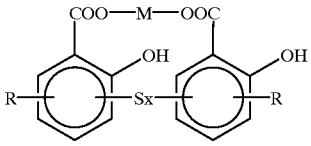

(wherein R is a chain hydrocarbon group having about 3 to 20 carbon atoms, M is a metal atom, and x denotes a number of about 1 to 5, the above formula is, however, a typical example), or the following formula (D1-7)

(D1-7)

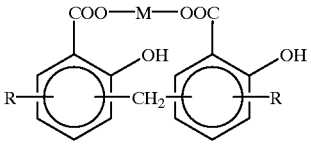

(wherein R is a chain hydrocarbon group having about 3 to 20 carbon atoms, M is a metal atom, and x denotes a number of about 1 to 5, the above formula is, however, a typical example).

Examples of the metal phosphonates include compounds represented by the following formula (D1-8)

(D1-8)

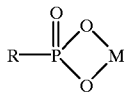

(wherein R is a polybutenyl group or another polyalkenyl group, and M is a metal atom) or the following formula (D1-9)

(D1-9)

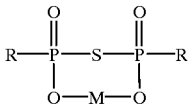

(wherein R is a polybutenyl group or another polyalkenyl group, and M is a metal atom).

The metal atom mentioned herein is preferably an alkali metal or an alkaline earth metal, and more preferably calcium, magnesium or barium.

The compounds represented by the above formulae are compounds generally referred to as neutral salts. Based or overbased metallic detergents are preferably used, which are obtained by basifying these neutral salts with, for example, metal oxides or metal hydroxides while blowing carbon dioxide into them. Such overbased products are generally contained in the form of carbonates. These based or overbased metallic detergents generally have a total base number (TBN) of about 200 to 500 mgKOH/g.

Of these metallic detergents, most preferred are neutral, based or overbased calcium salicylates or calcium sulfonates. The proportion of the component (D1) is preferably about 0.5 to 10% by weight relative to the lubricating base.

The component (D2), an ashless dispersant, includes, but is not limited to, succinimides, benzylamines, succinates, or boron-modified products of these compounds. Examples of the succinimides are compounds represented by the following formula (D2-1) exclusive of the arrow (D2-1)

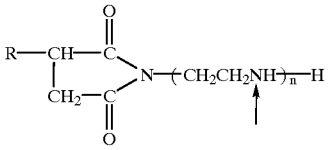

(wherein R is a polybutenyl group or another polyalkenyl group, and n denotes a number of about 1 to 10) or the following formula (D2-2) exclusive of the arrow (D2-2)

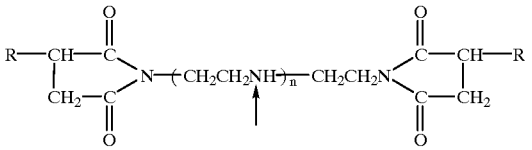

(wherein R is a polybutenyl group or another polyalkenyl group, and n denotes a number of about 1 to 10). The polyalkenyl group generally has a molecular weight of about 300 to 4000. The repetition number n is preferably from 2 to 5.

The benzylamines (products of a Mannich reaction) include, but are not limited to, compounds represented by the following formula (D2-3) exclusive of the arrow (D2-3)

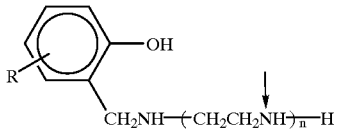

(wherein R is a polybutenyl group or another polyalkenyl group, and n denotes a number of about 1 to 10). The polyalkenyl group usually has a molecular weight of about 300 to 4000. The repetition number n is preferably from 2 to 5.

As the succinates, there may be mentioned for example compounds represented by the following formula (D2-4) exclusive of the arrows (D2-4)

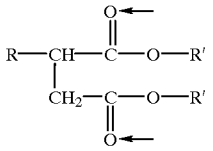

(wherein R is a polybutenyl group or another polyalkenyl group, and R' is a residue of a monohydric alcohol or polyol from which one hydroxyl group is eliminated), or by the following formula (D2-5) exclusive of the arrows (D2-5)

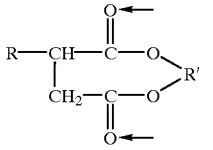

(wherein R is a polybutenyl group or another polyalkenyl group, and R' is a residue of a polyol from which two hydroxyl groups are eliminated). The molecular weight of the polyalkenyl group is about 300 to 4000.

The boron-modified products of the above compounds include, but are not limited to, the compounds in which a substituent represented by, for instance, the following formula (D2-a)

(D2-a)

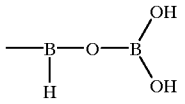

or the following formula (D2-b)

(D2-b)

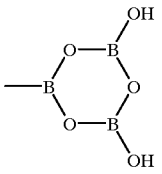

is coordinated to the position(s) indicated by the arrow(s) in the above formulae.

The nitrogen contents of the ashless dispersants are generally from about 0.5 to 2.0% by weight. Of these ashless dispersants, preferred are succinimides or their boron-modified products. The proportion of the component (D2) should preferably fall in the range from about 0.5 to 10% by weight.

Examples of the component (D3), a compound containing a phosphorus atom, include phosphines, phosphine oxides, phosphinites, phosphonites, phosphinates, phosphites, phosphonates, phosphates, phosphoroamidates, and other organo-phosphorus compounds. These compounds predominately serve to improve lubricating property and abrasion resistance, but sometimes they may also serve as antioxidants.

The organic phosphines represented by $(R)_3P$ include, but are not limited to, tributylphosphine, trihexylphosphine, trioctylphosphine, tri(2-ethylhexyl)phosphine, trinonylphosphine, tridecylphosphine, trilaurylphosphine, trimyristylphosphine, tripalmitylhosphine, tristearylphosphine, trioleylphosphine, triphenylphosphine, and tricresylphosphine. Alkylidenebisphosphines represented by $(R)_2P—(CH_2)_n—P(R)_2$ include, but are not limited to, methylenebis(dibutylphosphine), methylenebis(dihexylphosphine), methylenebis(dioctylphosphine), methylenebis(di-2-ethylhexylphosphine), methylenebis(dinonylphosphine), methylenebis(didecylphosphine), methylenebis(dilaurylphosphine), methylenebis(dimyristylphosphine), methylenebis(dipalmitylphosphine), methylenebis(distearylphosphine), methylenebis(dioleylphosphine), methylenebis(diphenylphosphine), and methylenebis(dicresylphosphine).

Examples of the organic phosphine oxides represented by $(R)_3P{=}O$ include tributylphosphine oxide, trihexylphosphine oxide, trioctylphosphine oxide, tri(2-ethylhexyl) phosphine oxide, trinonylphosphine oxide, tridecylphosphine oxide, trilaurylphosphine oxide, trimyristylphosphine oxide, tripalmitylphosphine oxide, tristearylphosphine oxide, trioleylphosphine oxide, triphenylphosphine oxide, and tricresylphosphine oxide.

The organic phosphites represented by $(RO)_3P$ include, but are not limited to, (mono-, di- or tri-)butyl phosphite, (mono-, di- or tri-)hexyl phosphite, (mono-, di- or tri-)octyl phosphite, (mono-, di- or tri-) 2-ethylhexyl phosphite, (mono-, di- or tri-)nonyl phosphite, (mono-, di- or tri-)decyl phosphite, (mono-, di- or tri-)lauryl phosphite, (mono-, di- or tri-)myristyl phosphite, (mono-, di- or tri-)palmityl phosphite, (mono-, di- or tri-)stearyl phosphite, (mono-, di- or tri-)oleyl phosphite, (mono-, di- or tri-)phenyl phosphite, and (mono-, di- or tri-)cresyl phosphite. As examples of the other phosphites, there may be mentioned pentaerythritol diphosphites represented by the following formula (D3-1)

(D3-1)

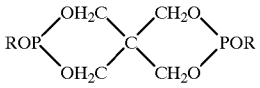

(wherein R is an alkyl group, an alkenyl group, an aryl group or another hydrocarbon group), pentaerythritol tetraphosphites represented by the following formula (D3-2)

(D3-2)

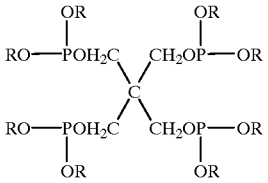

(wherein R is an alkyl group, an alkenyl group, an aryl group or another hydrocarbon group), and alkylidene bisphosphites represented by the following formula (D3-3)

(D3-3)

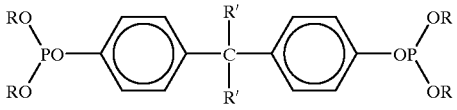

(wherein R is an alkyl group, an alkenyl group, an aryl group or another hydrocarbon group).

Examples of the organic phosphates represented by $(RO)_3P{=}O$ include (mono-, di-, or tri-)butyl phosphate, (mono-, di-, or tri-)hexyl phosphate, (mono-, di-, or tri-)octyl phosphate, (mono-, di-, or tri-) 2-ethylhexyl phosphate, (mono-, di-, or tri-)nonyl phosphate, (mono-, di-, or tri-) decyl phosphate, (mono-, di-, or tri-)lauryl phosphate, (mono-, di-, or tri-)myristyl phosphate, (mono-, di-, or tri-)palmityl phosphate, (mono-, di-, or tri-)stearyl phosphate, (mono-, di-, or tri-)oleyl phosphate, (mono-, di-, or tri-)phenyl phosphate, and (mono-, di-, or tri-)cresyl phosphate. In addition, the phosphates also include phosphates having a polyoxyalkylene group such as phosphates of lauryl alcohol ethylene oxide and/or propylene oxide adduct.

Of these phosphates, mono- or di-phosphates are referred to as acidic phosphates and may be used after neutralization with a base such as an alkali or amine. The alkali includes, but is not limited to, lithium hydroxide, sodium hydroxide, potassium hydroxide, magnesium hydroxide, calcium hydroxide, and other metal hydroxides. As the amine, there may be mentioned, for example, ammonia; methylamine, dimethylamine, ethylamine, diethylamine, (iso) propylamine, di(iso)propylamine, butylamine, hexylamine, octylamine, decylamine, dodecylamine, tridecylamine, cetylamine, coconut oil-derived alkylamines, soybean oil-derived alkylamines, beef tallow-derived alkylamines, oleylamine, stearylamine, and other alkylamines; monoethanolamine, N-methylmonoethanolamine, N-ethylmonoethanolamine, diethanolamine, N-methyldiethanolamine, N-ethyldiethanolamine, triethanolamine, 2-amino-2-methyl-1-propanol, 2-amino-2-methyl-1,3-propanediol, aminoethylethanolamine, N,N,N',N'-tetrakis(hydroxyethyl)ethylenediamine, N,N,N',N'-tetrakis(2-hydroxypropyl)ethylenediamine, and other alkanolamines or alkylene oxide adducts of these compounds; N-butyldiethanolamine, N-hexyldiethanolamine, N-octyldiethanolamine, N-decyldiethanolamine, N-coconut oil-derived alkyldiethanolamine, N-soybean oil-derived alkyldiethanolamine, N-beef tallow-derived alkyldiethanolamine, N-oleyldiethanolamine, N-stearyldiethanolamine, N,N-dibutylmonoethanolamine, N,N-dihexylmonoethanolamine, N,N-dioctylmonoethanolamine, N,N-didecylmonoethanolamine, N,N-bis(coconut oil-derived alkyl)monoethanolamine, N,N-bis(soybean oil-derived alkyl)monoethanolamine, N,N-bis(beef tallow-derived alkyl)monoethanolamine, N-dioleylmonoethanolamine, N-distearylmonoethanolamine, and other N-long chain alkyl-alkanolamines or alkylene oxide adducts of these amines.

The phosphoroamidates include ones obtained by condensation reaction of the above phosphates with the amines. The preferred proportion of the component (D3) is about 0.1 to 5% by weight relative to the lubricating base.

As the component (D4), a compound containing a phosphorus atom and a sulfur atom, there may be mentioned, for example, trithiophosphites, and thiophosphates. These compounds predominantly serve to improve, for instance, lubricating property and abrasion resistance but they may also serve as antioxidants in some cases.

The organic trithiophosphites represented by $(RS)_3P$ include, but are not limited to, (mono-, di-, or tri-)butyl trithiophosphite, (mono-, di-, or tri-)hexyl trithiophosphite, (mono-, di-, or tri-)octyl trithiophosphite, (mono-, di-, or tri-) 2-ethylhexyl trithiophosphite, (mono-, di-, or tri-)nonyl trithiophosphite, (mono-, di-, or tri-)decyl trithiophosphite, (mono-, di-, or tri-)lauryl trithiophosphite, (mono-, di-, or tri-)myristyl trithiophosphite, (mono-, di-, or tri-)palmityl trithiophosphite, (mono-, di-, or tri-)stearyl trithiophosphite, (mono-, di-, or tri-)oleyl trithiophosphite, (mono-, di-, or tri-)phenyl trithiophosphite, and (mono-, di-, or tri-)cresyl trithiophosphite.

The organic thiophosphates represented by $(RO)_3P{=}S$ include, but are not limited to, (mono-, di-, or tri-)butyl thiophosphate, (mono-, di-, or tri-)hexyl thiophosphate, (mono-, di-, or tri-)octyl thiophosphate, (mono-, di-, or tri-) 2-ethylhexyl thiophosphate, (mono-, di-, or tri-)nonyl thiophosphate, (mono-, di-, or tri-)decyl thiophosphate, (mono-, di-, or tri-)lauryl thiophosphate, (mono-, di-, or tri-)myristyl thiophosphate, (mono-, di-, or tri-)palmityl thiophosphate, (mono-, di-, or tri-)stearyl thiophosphate, (mono-, di-, or tri-)oleyl thiophosphate, (mono-, di-, or tri-)phenyl thiophosphate, and (mono-, di-, or tri-)cresyl thiophosphate.

In addition, use can be made of dithiophosphate dimers represented by the following formula (D4-1)

(D4-1)

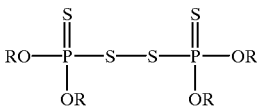

(wherein R is a hydrocarbon group, preferably an alkyl group having 3 to 18 carbon atoms). The proportion of the component (D4) should preferably fall in the range from about 0.1 to about 5% by weight relative to the lubricating base.

The component (D5), a compound containing sulfur atoms and no metal atoms, includes, but is not limited to, sulfurized lard, sulfurized fish oil, sulfurized whale oil, sulfurized soybean oil, sulfurized pinene oil, sulfurized sperm oil, sulfurized fatty acids and other derivatives derived from oils and fats whose double bonds are sulfurized, as well as elementary sulfur, organic mono- or poly-sulfides, sulfides of isobutylene and other polyolefins, 1,3,4-thiadiazole derivatives, thiuram disulfides, dithiocarbamates and the like.

The organic mono- or poly-sulfides represented by the following formula (D5-1)

$$R{-}S_x{-}R \qquad \text{(D5-1)}$$

include, but are not limited to, dimethyl (mono-, di-, or poly-)sulfide, diethyl (mono-, di-, or poly-)sulfide, dipropyl (mono-, di-, or poly-)sulfide, diisopropyl (mono-, di-, or poly-)sulfide, dibutyl (mono-, di-, or poly-)sulfide, diisobutyl (mono-, di-, or poly-)sulfide, di-tertiary-butyl (mono-, di-, or poly-)sulfide, dipentyl (mono-, di-, or poly-)sulfide, diisopentyl (mono-, di-, or poly-)sulfide, dineopentyl (mono-, di-, or poly-)sulfide, di-tertiary-pentyl (mono-, di-, or poly-)sulfide, dihexyl (mono-, di-, or poly-)sulfide, diheptyl (mono-, di-, or poly-)sulfide, dioctyl (mono-, di-, or poly-)sulfide, di-2-ethylhexyl (mono-, di-, or poly-)sulfide, dinonyl (mono-, di-, or poly-)sulfide, di-tertiary-nonyl (mono-, di-, or poly-)sulfide, didecyl (mono-, di-, or poly-)sulfide, diundecyl (mono-, di-, or poly-)sulfide, didodecyl (mono-, di-, or poly-)sulfide, ditridecyl (mono-, di-, or poly-)sulfide, diisotridecyl (mono-, di-, or poly-)sulfide, ditetradecyl (mono-, di-, or poly-)sulfide, dihexadecyl (mono-, di-, or poly-)sulfide, distearyl (mono-, di-, or poly-)sulfide, diisostearyl (mono-, di-, or poly-)sulfide, dioleyl (mono-, di-, or poly-)sulfide, diicosyl (mono-, di-, or poly-)sulfide, didocosyl (mono-, di-, or poly-)sulfide, ditetracosyl (mono-, di, or poly-)sulfide, ditriacontyl (mono-, di-, or poly-)sulfide, diphenyl (mono-, di-, or poly-)sulfide, ditoluyl (mono-, di-, or poly-)sulfide, dixylyl (mono-, di-, or poly-)sulfide, dicumenyl (mono-, di-, or poly-)sulfide, dimesityl (mono-, di-, or poly-)sulfide, dibenzyl (mono-, di-, or poly-)sulfide, diphenethyl (mono-, di-, or poly-)sulfide, distyryl (mono-, di-, or poly-)sulfide, dicinnamyl (mono-, di-, or poly-)sulfide, dibenzhydryl (mono-, di-, or poly-)sulfide, ditrityl (mono-, di-, or poly-)sulfide, di(ethylphenyl) (mono-, di-, or poly-)sulfide, di(propylphenyl) (mono-, di-, or poly-)sulfide, di(butylphenyl) (mono-, di-, or poly-)sulfide, di(pentylphenyl) (mono-, di-, or poly-)sulfide, di(hexylphenyl) (mono-, di-, or poly-)sulfide, di(heptylphenyl) (mono-, di-, or poly-)sulfide, di(octylphenyl) (mono-, di-, or poly-)sulfide, di(nonylphenyl) (mono-, di-, or poly-)sulfide, di(decylphenyl) (mono-, di-, or poly-)sulfide, di(undecylphenyl) (mono-, di-, or poly-)sulfide, di(dodecylphenyl) (mono-, di-, or poly-)sulfide, di(phenylphenyl) (mono-, di-, or poly-)sulfide, di(benzylphenyl) (mono-, di-, or poly-)sulfide, di(styrenated phenyl) (mono-, di-, or poly-)sulfide, di(p-cumylphenyl) (mono-, di-, or poly-)sulfide, dicyclopentyl (mono-, di-, or poly-)sulfide, dicyclohexyl (mono-, di-, or poly-)sulfide, dicycloheptyl (mono-, di-, or poly-)sulfide, dimethylcyclopentyl (mono-, di-, or poly-)sulfide, dimethylcyclohexyl (mono-, di-, or poly-)sulfide, dimethylcycloheptyl (mono-, di-, or poly-)sulfide, and other dihydrocarbyl sulfides; di(ethylhydroxyphenyl) (mono-, di-, or poly-)sulfide, di(propylhydroxyphenyl) (mono-, di-, or poly-)sulfide, di(butylhydroxyphenyl) (mono-, di-, or poly-)sulfide, di(pentylhydroxyphenyl) (mono-, di-, or poly-)sulfide, di(hexylhydroxyphenyl) (mono-, di-, or poly-)sulfide, di(heptylhydroxyphenyl) (mono-, di-, or poly-)sulfide, di(octylhydroxyphenyl) (mono-, di-, or poly-)sulfide, di(nonylhydroxyphenyl) (mono-, di-, or poly-)sulfide, di(decylhydroxyphenyl) (mono-, di-, or polylfide, di(undecylhydroxyphenyl) (mono )sulfide, di(dodecylhydroxyphenyl) (mono-, di-, or poly-)sulfide, and other dihydrocarbylphenol sulfides.

The 1,3,4-thiadiazole derivatives are represented by the following formula (D5-2)

(D5-2)

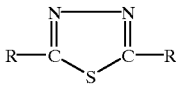

(wherein R is a hydrocarbon group or a sulfur-atom-containing hydrocarbon group).

Such sulfur-atom-containing hydrocarbon groups include, but are not limited to, 5-thianonyl, 2,5-dithianonyl, 3,4-dithiahexyl, 4,5-dithiahexyl, 3,4,5-trithiaheptyl, 3,4,5,6-tetrathiaoctyl, 5-thia-2-heptenyl, 4-thiacyclohexyl, 1,4-dithianaphthyl, 5-(methylthio)octyl, 4-(ethylthio)-2-pentenyl, 4-(methylthio)cyclohexyl, 4-mercaptophenyl, 4-(methylthio)phenyl, 4-(hexylthio)benzyl, stearyldithio, lauryldithio, octyldithio, stearylthio, laurylthio, octylthio, and N,N-dialkyldithiocarbamoyl. Of these groups, preferred are groups each comprising two to four sulfur atoms bonded successively.

The thiuram disulfides are represented by the following formula (D5-3)

(D5-3)

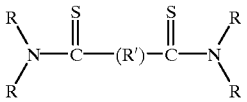

(wherein R is a hydrocarbon group, R' is a sulfur atom, a divalent hydrocarbon group or a divalent hydrocarbon group containing a sulfur atom).

In the above formula, R' includes, but is not limited to, a group represented by $—S(—S)_n—$, where n denotes 0 or a number of 1 or more, a methylene group, a group represented by $—S(—S)_n(—CH_2)_n—S(—S)_n—$, where n is an identical or different number of 0, 1 or more). As R, chain hydrocarbon groups each having 4 or more carbon atoms are preferred.

The dithiocarbamates are represented by the following formula (D5-4)

(D5-4)

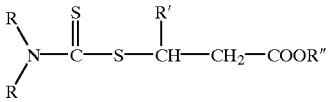

(wherein R is a hydrocarbon group, and R' is a hydrogen atom, a hydrocarbon group, or a group represented by COOR", where R" is a hydrocarbon group). The proportion of the component (D5) is preferably from about 0.1 to about 10% by weight relative to the lubricating base.

The component (D6), a sulfurous antioxidant, includes, but is not limited to, dioctyl thiodipropionate, didecyl thiodipropionate, dilauryl thiodipropionate, dimyristyl thiodipropionate, distearyl thiodipropionate, laurylstearyl thiodipropionate, distearyl-β,β'-thiodibutyrate, (3-octylthiopropionic acid) pentaerythritol tetraester, (3-decylthiopropionic acid) pentaerythritol tetraester, (3-laurylthiopropionic acid) pentaerythritol tetraester, (3-stearylthiopropionic acid) pentaerythritol tetraester, (3-oleylthiopropionic acid) pentaerythritol tetraester, (3-laurylthopropionic acid)-4,4'-thiodi(3-methyl-5-tert.-butyl- 4-phenyl) ester, 2-mercaptobenzimidazole, 2-mercaptomethylbenzimidazole, 2-benzimidazole disulfide, dilauryl sulfide, and amyl thioglycolate. The proportion of the component (D6) is preferably from about 0.01 to about 5% by weight relative to the lubricating base.

The component (D7), an organometallic compound, serves to improve the abrasion resistance and oxidation inhibitory property, and includes, for instance, lithium, sodium, potassium, magnesium, calcium, barium, titanium, zinc, lead, tin, iron, cadmium, cobalt, nickel, manganese, strontium, vanadium, copper, antimony, bismuth, molybdenum, and tungsten salts of hexanoic acid, octanoic acid, pelargonic acid, decanoic acid, lauric acid, myristic acid, palmitic acid, stearic acid, oleic acid, behenic acid, linoleic acid, linolenic acid, and other fatty acids or naphthenic acids. As such fatty acids, those having about 12 to 18 carbon atoms are preferred.

In addition, the component (D7) includes, metal salts of dithiophosphoric acids represented by the following formula (D7-1)

(D7-1)

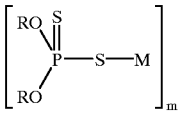

(wherein R is a hydrocarbon group, preferably an alkyl group having 3 to 22 carbon atoms, exclusive of the same compounds with the component (C)), metallic salt of dithiocarbamic acids represented by the following formula (D7-2)

(D7-2)

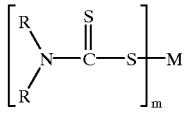

(wherein R is a hydrocarbon group, preferably an alkyl group having 3 to 22 carbon atoms), mercaptobenzothiazoles represented by the following formula (D7-3)

(D7-3)

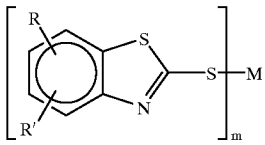

(wherein R and R' are each a hydrocarbon group, preferably an alkyl group having 3 to 22 carbon atoms), mercaptobenzimidazoles represented by the following formula (D7-4)

(D7-4)

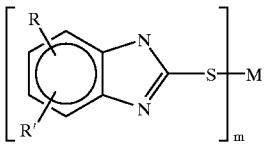

(wherein R and R' are each a hydrocarbon group, preferably an alkyl group having 3 to 22 carbon atoms), and benzamidethiophenols represented by the following formula (D7-5)

(D7-5)

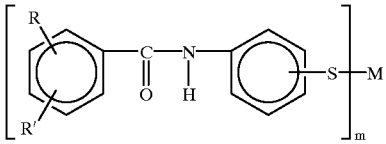

(wherein R and R' are each a hydrocarbon group, preferably an alkyl group having 3 to 22 carbon atoms). In these formulae, m denotes the valency of M, and M is a metal atom such as lithium, sodium, potassium, magnesium, calcium, barium, titanium, zinc, lead, tin, iron, cadmium, cobalt, nickel, manganese, strontium, vanadium, copper, antimony, bismuth, molybdenum, or tungsten.

In addition, as compounds containing a molybdenum atom, there may be mentioned oxymolybdenum dithiophosphate sulfides represented by the following formula (D7-6)

(D7-6)

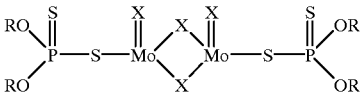

(wherein R is a hydrocarbon group, preferably an alkyl group having 3 to 18 carbon atoms, and X is a sulfur atom or an oxygen atom), reaction products of an amine represented by R—NH—R' with a compound containing a hexavalent molybdenum atom such as molybdenum trioxide, reaction products of an acidic phosphoric acid ester with a compound containing a hexavalent molybdenum atom, compounds represented by the following formula (D7-7)

(D7-7)

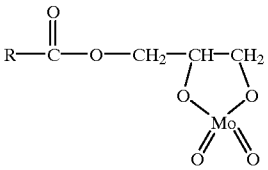

(wherein R is a hydrocarbon group, preferably an alkyl group having 3 to 18 carbon atoms), compounds represented by the following formula (D7-8)

(D7-8)

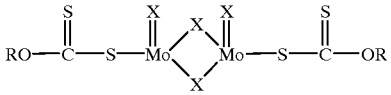

(wherein R is a hydrocarbon group, preferably an alkyl group having 3 to 18 carbon atoms, and X is a sulfur atom or an oxygen atom), and compounds represented by the following formula (D7-9)

(D7-9)

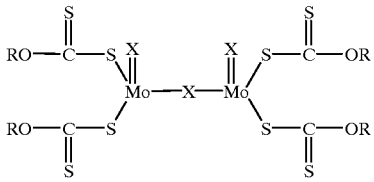

(wherein R is a hydrocarbon group, preferably an alkyl group having 3 to 18 carbon atoms, and X is a sulfur atom or an oxygen atom). The proportion of the component (D7) should preferably fall in the range from about 0.05 to about 10% by weight relative to the lubricating base.

The component (D8) is an oiliness improver containing no metal atoms, no phosphorus atoms and no sulfur atoms. The component includes, but is not limited to, hexanoic acid, octanoic acid, pelargonic acid, decanoic acid, lauric acid, myristic acid, palmitic acid, stearic acid, oleic acid, behenic acid, linoleic acid, linolenic acid, and other fatty acids; linseed oil, perilla oil, oiticica oil, olive oil, cocoa butter, kapok oil, white mustard oil, sesame oil, rice bran oil, safflower oil, Shearnut oil, Chinese tung oil, soybean oil, tea seed oil, camellia oil, corn oil, rapeseed oil, palm oil, palm kernel oil, castor oil, sunflower oil, cotton seed oil, coconut oil, haze wax, peanut oil, horse fat, beef tallow, neat'-foot oil, ghee, lard, goat tallow, mutton tallow, milk fat, fish oil, whale oil, and other fats and oils, or hydrogenated products or partially-saponified products of these fats and oils; epoxidized soybean oil, epoxidized linseed oil, and other epoxidized fats and oils; butyl epoxystearate, octyl epoxystearate, and other epoxidized esters; glutaric acid, adipic acid, pimelic acid, suberic acid, azelaic acid, sebacic acid, dodecanedioic acid, dimeric acids, and other dibasic acids; polycondensation products of ricinoleic acid (fatty acid from castor oil), 12-hydroxystearic acid, and other hydroxy-fatty acids, or esters of the polycondensation products with fatty acids; lauryl alcohol, myristyl alcohol, palmityl alcohol, stearyl alcohol, oleyl alcohol, behenyl alcohol, and other higher alcohols; laurylamine, myristylamine, palmitylamine, stearylamine, oleylamine, behenylamine, and other higher amines; lauramide, myristamide, palmitamide, stearamide, oleamide, behenamide, and other higher amides; lauryldiethanolamide, myristyldiethanolamide, palmityldiethanolamide, stearyldiethanolamide, oleyldiethanolamide, behenyldiethanolamide, and other diethanolamides; hexanoic acid (mono-, di- or tri-)glyceride, octanoic acid (mono-, di- or tri-)glyceride, decanoic acid (mono-, di- or tri-)glyceride, lauric acid (mono-, di- or tri-)glyceride, myristic acid (mono-, di- or tri-)glyceride, palmitic acid (mono-, di- or tri-)glyceride, stearic acid (mono-, di- or tri-)glyceride, oleic acid (mono-, di- or tri-)glyceride, behenic acid (mono-, di- or tri-)glyceride, and other glycerides; hexanoic acid polyglycerol ester, octanoic acid polyglycerol ester, decanoic acid polyglycerol ester, lauric acid polyglycerol ester, myristic acid polyglycerol ester, palmitic acid polyglycerol ester, stearic acid polyglycerol ester, oleic acid polyglycerol ester, behenic acid polyglycerol ester, and other polyglycerol esters; hexanoic acid sorbitan ester, octanoic acid sorbitan ester, decanoic acid sorbitan ester, lauric acid sorbitan ester, myristic acid sorbitan ester, palmitic acid sorbitan ester, stearic acid sorbitan ester, oleic acid sorbitan ester, behenic acid sorbitan ester, and other sorbitan esters; (poly)glycerol monooctyl ether, (poly)glycerol monodecyl ether, (poly)glycerol monolauryl ether, (poly)glycerol monooleyl ether, (poly)glycerol monostearyl ether, and other (poly)glycerol ethers; adducts of the above compounds with ethylene oxide, propylene oxide, dodecan-1,2-oxide and other α-olefin oxides. The preferred proportion of the component (D8) ranges from about 0.05 to about 10% by weight relative to the lubricating base.

The component (D9) is a rust inhibitor. The component includes, but is not limited to, the sulfonates described relating to the metal detergent, sodium nitrite, calcium salts of oxidized paraffin wax, magnesium salts of oxidized paraffin wax, alkali metal salts, alkaline earth metal salts or amine salts of beef tallow fatty acids, alkenyl succinates or alkenyl succinic acid half esters (whose alkenyl moiety has a molecular weight of about 100 to 300), sorbitan monoesters, pentaerythritol monoesters, glycerol monoesters, nonylphenyl ethoxylate, lanolin fatty acid esters, and calcium salts of lanolin fatty acids. The proportion of the component (D9) relative to the lubricating base is preferably from about 0.1 to about 15% by weight.

The component (D10) is a viscosity index improver, and includes, but is not limited to, poly(C1-18)alkyl methacrylates, (C1-18)alkyl acrylate/(C1-18)alkyl methacrylate copolymers, diethylaminoethyl methacrylate/(C1-18)alkyl methacrylate copolymers, ethylene/(C1-18)alkyl methacrylate copolymers, polyisobutylene, polyalkylstyrenes, ethylene/propylene copolymers, styrene/maleate copolymers, styrene/maleamide copolymers, styrene/butadiene hydrogenated copolymers, and styrene/isoprene hydrogenated copolymers. The average molecular weight of the component ranges from about 10,000 to about 1,500,000. The proportion of the component (D10) should preferably fall in the range from about 0.1 to about 20% by weight relative to the lubricating base.

The component (D11) is a metal deactivator, and includes, for instance, N,N'-salicylidene-1,2-propanediamine, alizarin, tetraalkyl thiuram disulfides, benzotriazole, benzimidazole, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, and 2,5-bis(N,N-dialkyldithiocarbamoyl)-1,3,4-thiadiazoles. The proportion of the component (D11) should preferably fall in the range from about 0.01 to about 5% by weight relative to the lubricating base.

The component (D12) is an antifoaming agent, and includes, but is not limited to, polydimethyl silicone, trifluoropropylmethyl silicone, colloidal silica, poly(alkyl acrylate), poly(alkyl methacrylate), alcohol ethoxy/propoxylates, fatty acid ethoxy/propoxylates, and sorbitan partially fatty acid esters. The preferred proportion of the component (D12) is from about 0.001 to about 1% by weight relative to the lubricating base.

The component (D13) is a solid lubricant, and includes, for example, graphite, molybdenum disulfide, poly (tetrafluoroethylene), alkaline earth metal salts of fatty acids, mica, cadmium dichloride, cadmium diiodide, calcium fluoride, lead iodide, lead oxide, titanium carbide, titanium nitride, aluminium silicate, antimony oxide, cerium fluoride, polyethylene, diamond powder, silicon nitride, boron nitride carbon fluoride, and melamine isocyanurate. The preferred proportion of the component (D13) is from about 0.005 to about 2% by weight relative to the lubricating base.

The substituent R indicated in the above formulae described in the explanation of the components (D) represents a hydrocarbon group, preferably an alkyl group, an alkenyl group or an aryl group, otherwise specifically defined.

Each of the aforementioned components (D) can be used singly or in combination. When the lubricating composition of the present invention is used as a lubricating oil for internal combustion engines, it preferably comprises at least the metallic detergent (D1) and the ashless dispersant (D2).

Lubricating Base

Lubricating bases to be used in the present invention include base oils for lubricating oils, which are composed of mineral oils, synthetic oils or mixtures of these oils, and base greases in which a thickener is compounded in any of the base oils. When it is used as an aqueous lubricating oil, the base is water.

When the lubricating composition of the present invention is used as a lubricating oil, the kinematic viscosity of the base oils preferably ranges, but is not limited to, from about 1 to about 50 $mm^2/s$ at 100° C., and from about 10 to 1000 $mm^2/s$ at 40° C., and its viscosity index (VI) is preferably equal to or more than 100, more preferably equal to or more than 120, and most preferably equal to or more than 135.

Mineral oils to be used as the base oil in the present invention are separated from natural crude oils and manufactured by subjecting these crude oils to distillation, purification or another proper process. Such mineral oils predominately contain hydrocarbons (mainly paraffins), and they contain, in addition, monocyclic naphthene contents, bicyclic naphthene contents, and aromatic fractions, for example. Base oils can preferably be used, which are obtained by subjecting these oils to refining means such as hydrogenation refining, solvent deasphalting, solvent extraction, solvent dewaxing, hydrogenation dewaxing, catalytic dewaxing, hydrogenolysis, alkali distillation, sulfuric acid washing, or clay treatment. These refining means are employed in an appropriate combination, and it is also effective to repeat the same treatment in a multiplicity of steps. For instance, the following processes are effective: (A) a process of extracting a distillate oil with a solvent or further subjecting the extracted oil to hydrogenation treatment, and then washing the same with sulfuric acid, (B) a process of subjecting a distillate oil to hydrogenation treatment and then subjecting the hydrogenated oil to dewaxing treatment, (C) a process of extracting a distillate oil with a solvent and then subjecting the same to hydrogenation treatment, (D) a process of extracting a distillate oil with a solvent and then subjecting the same to clay treatment, (E) a process of hydrogenation treatment of a distillate oil at two or more stages, or subjecting the hydrogenated oil to alkali distillation or sulfuric acid washing treatment, (F) a process of hydrogenation treatment of a distillate oil, or subjecting the hydrogenated oil to alkali distillation or sulfuric acid washing treatment, or mixing these treated oils.

These treatments can remove aromatic components, sulfur content, nitrogen content and the like in unrefined mineral oils. According to presently employed techniques, these impurities can be reduced and removed to trace amounts or below. However, aromatic components serve to facilitate the dissolution of lubricating oil additives, and may be allowed to remain about 3 to 5% by weight in some cases. By way of illustration, the proportions of the sulfur content and nitrogen content in present highly refined mineral oils are 0.01% by weight or less, and in some cases, 0.005% by weight or less. On the contrary, the amount of the aromatic components is equal to or less than 1% by weight, and, some oils contain aromatic components equal to or less than 0.05% by weight, or others may contain them in an amount of about 3% by weight.

Synthetic oils to be used as the base oil in the present invention are lubricating oils obtained chemically synthetically, and include, for example, poly-α-olefins, polyisobutylene (polybutene), diesters, polyol esters, aromatic polycarboxylic acid esters, phosphoric acid esters, silicic acid esters, polyalkylene glycols, polyphenyl ethers, silicones, fluorinated compounds, and alkylbenzenes. Of these compounds, poly-α-olefins, polyisobutylene (polybutene), diesters, polyol esters, and polyalkylene glycols can be used for general purposes, and can advantageously be used for oils for internal combustion engines and processing oils.

The poly-α-olefins include, but are not limited to, polymers or oligomers of, for example, 1-hexene, 1-octene, 1-nonene, 1-decene, 1-dodecene, and 1-tetradecene, or hydrogenated products of these polymers and oligomers. The diesters include, but are not limited to, diesters of glutaric acid, adipic acid, azelaic acid, sebacic acid, dodecanedioic acid or another dibasic acid with 2-ethylhexanol, octanol, decanol, dodecanol, tridecanol or another alcohol. As examples of the polyol esters, there may be mentioned esters of neopentyl glycol, trimethylolethane, trimethylolpropane, glycerol, pentaerythritol, sorbitol, dipentaerythritol, tripentaerythritol, or alkylene oxide adducts of these compounds, and other polyols with butyric acid, isobutyric acid, valeric acid, isovaleric acid, pivalic acid, capric acid, caproic acid, caprylic acid, lauric acid, myristic acid, palmitic acid, stearic acid, oleic acid and other fatty acids. The polyalkylene glycols include, but are not limited to, polyethylene glycol, polypropylene glycol, polyethylene glycol monomethyl ether, and mono- or di-methyl ethers of block- or random-copoly(ethylene oxide/propylene oxide).

These synthetic oils are chemically synthesized and are each a simple substance or a mixture of homologues. Accordingly, poly-α-olefins, polyisobutylene (polybutene), diesters, polyol esters, polyalkylene glycols and other synthetic oils contain no impurities as in mineral oils, which impurities include benzene and other condensed polycyclic aromatic components, thiophene and other sulfur contents, and indole, carbazole, and other nitrogen contents.

When the lubricating composition is used as a grease, a composition of a lubricating base with a thickener is used as a base grease. Such thickeners include, for example, soap-based or complex soap-based thickeners, terephthalamate-based thickeners, urea-based thickeners, polytetrafluoroethylene, fluorinated ethylene-propylene copolymers, and other organic non-soap thickeners, and inorganic non-soap thickeners. Each of these thickeners can be used singly or in combination. The proportion of the thickener is not limited, but is preferably from 3 to 40% by weight, and more preferably from 5 to 20% by weight relative to the base grease composed of the base oil and the thickener. The consistency of the base grease composed of the base oil and thickener is generally, but not limited to, about 100 to 500.

The alkali metal content in the lubricating composition should preferably be equal to or less than 0.02% by weight, and more preferably equal to or less than 0.01% by weight in terms of total alkali metal contents in the lubricating composition. This is because if the content of alkali metal in the lubricating composition is excessively large, the friction modifying properties may sometimes be reduced. Such alkali metals may contaminate the lubricating composition in the case when alkali metals used as a raw material, catalysts or the like in separation, refining and synthesis steps of the base oil are not completely eliminated. In addition, the alkali metals are frequently used as a material, catalyst and the like in the synthesis process of lubricating oil additives and if they are not completely eliminated, they will contaminate the lubricating composition. For example, in the preparation process of oxymolybdenum dithiocarbamate sulfides, inorganic substances containing alkali metals are frequently used. Furthermore, sodium nitrite or sodium sulfonate is used as a rust inhibitor, and alkali metal compounds are added as detergents or dispersants and they may become a contaminate.

Lubricating Composition

The lubricating composition of the present invention preferably comprises a given amount or more of nitrogen contents for improving long drain properties. The total nitrogen content of the lubricating composition of the present invention should preferably be equal to or more than 0.01% by weight, more preferably equal to or more than 0.03% by weight and most preferably equal to or more than 0.05% by weight. Such nitrogen contents may be incorporated in the lubricating composition, for example, when an aminic antioxidant is used as the antioxidant, when an ashless dispersant is used, when a dithiocarbamate derivative is used, or when a fatty acid amide is used.

The lubricating composition of the present invention can be used for lubrication in any application including, for example, lubricating oils for industrial applications, turbine oils, machine oils, bearing oils, compressor oils, hydraulic oils, operating oils, internal combustion engine oils, refrigerating machine oils, gear oils, automatic transmission fluid (ATF), continuously variable transmission oils (CVT oils), transaxle fluids, and metal-processing oils. Separately, the lubricating composition can be used as an additive to a variety of greases, for sliding bearings, rolling bearings, gears, universal joints, torque limiters, constant velocity joints (CVJs) for automobiles, ball joints, wheel bearings, constant velocity gears, and transmission gears.

However the most preferable application of the lubricating composition of the present invention is as a lubricating oil for internal combustion engines.

EXAMPLES

The invention will be further illustrated in detail with reference to several examples. Parts and percentage in the examples are by weight unless otherwise specifically defined.

Example 1

A series of lubricating compositions were prepared by adding each of the components (A1), (A2), (B) and (C) in the proportions indicated in table 1 to the base oils described below. The low-temperature stability and long drain properties of these lubricating compositions were rated in the methods mentioned below. The base oils used were as follows.

Inventive samples 1 to 16: base oil 1

Inventive sample 17: base oil 2

Inventive sample 18: base oil 3

Comparative samples 1 to 3: base oil 1

(i) Base Oil for Lubricating Oil

Base oil 1:

mineral oil-based high VI oil kinematic viscosity:

4.1 $m^2/s$ (100° C.), 18.3 $mm^2/s$ (40° C.), viscosity index (VI)=126

Base oil 2:

synthetic oil obtained by oligomerization of 1-decene and composed of 80% of poly-α-olefins and 20% of polyol esters.

kinematic viscosity:

4.0 $mm^2/s$ (100° C.), 16.9 $mm^2/s$ (40° C.), viscosity index (VI)=138

Base oil 3:

mixed base oil obtained by blending the base oil 1 and base oil 2 in a ratio of 1:1.

(ii) Component (A1)

(A1-1):

$R^1$=$R^2$=2-ethylhexyl group, $R^3$=$R^4$=isotridecyl group,

S/O=2.0/2.0 in $X^1$ to $X^4$ in the formula (1)

(iii) Component (A2)

(A2-1):

$R^5$=2-ethylhexyl group,

S/O=2.0/2.0 in $X^5$ to $X^8$ in the formula (2)

(A2-2):

$R^5$=isotridecyl group,

S/O=2.0/2.0 in $X^1$ to $X^4$ in the formula (2)

(iv) Component (B)

(B-1): 4,4'-methylenebis(2,6-di-tert.-butylphenol)

(B-2): oleyl 3-(3,5-di-tert.-butyl-4-hydroxy)propionate (B-3): 2,2-thio-{diethyl-bis-3-(3,5-di-tert.-butyl-4-hydroxyphenyl)}propionate (B-4): p,p'-dioctyldiphenylamine (B-5): p-octylphenyl-1-naphthylamine (v) Component (C)

(C-1):

$R^6$=$R^7$=2-ethylhexyl group,

[a=0/a=1/3]=95/5

(C-2):

$R^6$=$R^7$=dodecyl group,

[a=0/a=1/3]=60/40

(C-3):

$R^6$=$R^7$=n-octyl group,

[a=0/a=1/3]=80/20

(C-4):

$R^6$=$R^7$=secondary propyl group and secondary hexyl group,

[a=0/a=1/3]=95/5

<Methods for Assays>

(i) Low-temperature Stability Test

Each of the inventive and comparative lubricating compositions was stored at −10° C. for one month, and the presence or absence of precipitates in the composition after one-month storage was observed visually.

X: no precipitate

O: precipitate (ii) Assay of Frictional Coefficient

According to the method described in Japanese Industrial Standards (JIS) K-2514, each of the inventive and comparative lubricating compositions was oxidized and deteriorated by stirring at a temperature of a thermostat of 170° C. at a rotation rate of a sample stirrer of 1300 rpm for 20 hours. The frictional coefficient of each of these deteriorated oils was measured with the use of an SRV measurer under a line contact condition of cylinder-on-plate. To be more specific, an upper cylinder (ϕ15×22 mm) was placed on a plate (ϕ24×6.85 mm) in the perpendicular direction to the sliding direction and was reciprocated and vibrated to measure frictional coefficient. In this connection, the cylinder and plate were both composed of SUJ-2. Detail conditions are as follows.

<Conditions>

Load: 200 N

Temperature: 80° C.

Measuring time: 15 min.

Amplitude: 1 mm

Cycle: 50 Hz

Table 1 shows the compositions and the above test results of the individual lubricating compositions.

TABLE 1

| | Component (A-1) | | Component (A-2) | | Component | | Component | | Preci- | frictional |
|---|---|---|---|---|---|---|---|---|---|---|
| | | (Mo ppm) | | (Mo ppm) | (B) | (%) | (C) | (P %) | pitate | coefficient |
| Inventive Sample 1 | (A1-1) | 400 | (A2-1) | 300 | (B-1) | 0.5 | (C-1) | 0.10 | X | 0.065 |
| Inventive Sample 2 | (A1-1) | 300 | (A2-1) | 400 | (B-1) | 0.5 | (C-1) | 0.10 | X | 0.065 |
| Inventive Sample 3 | (A1-1) | 200 | (A2-1) | 500 | (B-1) | 0.5 | (C-1) | 0.10 | X | 0.065 |
| Inventive Sample 4 | (A1-1) | 500 | (A2-2) | 200 | (B-1) | 0.5 | (C-1) | 0.10 | X | 0.065 |
| Inventive Sample 5 | (A1-1) | 400 | (A2-1) | 100 | (B-1) | 0.2 | (C-1) | 0.30 | X | 0.070 |
| Inventive Sample 6 | (A1-1) | 300 | (A2-1) | 200 | (B-1) | 0.5 | (C-1) | 0.10 | X | 0.070 |
| Inventive Sample 7 | (A1-1) | 300 | (A2-1) | 300 | (B-1) | 0.5 | (C-1) | 0.05 | X | 0.070 |
| Inventive Sample 8 | (A1-1) | 300 | (A2-1) | 500 | (B-1) | 1.0 | (C-1) | 0.10 | X | 0.055 |

TABLE 1-continued

| | Component (A-1) (Mo ppm) | | Component (A-2) (Mo ppm) | | Component (B) | (%) | Component (C) | (P %) | Precipitate | frictional coefficient |
|---|---|---|---|---|---|---|---|---|---|---|
| Inventive Sample 9 | (A1-1) | 100 | (A2-1) | 100 | (B-1) | 1.0 | (C-1) | 0.10 | X | 0.065 |
| Inventive Sample 10 | (A1-1) | 400 | (A2-1) | 300 | (B-1) | 2.0 | (C-2) | 0.10 | X | 0.065 |
| Inventive Sample 11 | (A1-1) | 400 | (A2-1) | 300 | (B-1) | 0.5 | (C-1)<br>(C-3) | 0.05<br>0.05 | X | 0.065 |
| Inventive Sample 12 | (A1-1) | 400 | (A2-1) | 300 | (B-2) | 0.5 | (C-1) | 0.10 | X | 0.070 |
| Inventive Sample 13 | (A1-1) | 400 | (A2-2) | 300 | (B-3) | 0.5 | (C-2) | 0.10 | X | 0.070 |
| Inventive Sample 14 | (A1-1) | 400 | (A2-1) | 300 | (B-4) | 0.5 | (C-2)<br>(C-3) | 0.05<br>0.05 | X | 0.070 |
| Inventive Sample 15 | (A1-1) | 400 | (A2-1) | 300 | (B-5) | 0.5 | (C-2) | 0.10 | X | 0.075 |
| Inventive Sample 16 | (A1-1) | 400 | (A2-1) | 300 | (B-1) | 0.5 | (C-2)<br>(C-4) | 0.05<br>0.05 | X | 0.075 |
| Inventive Sample 17 | (A1-1) | 400 | (A2-1) | 300 | (B-1) | 0.5 | (C-1) | 0.10 | X | 0.065 |
| Inventive Sample 18 | (A1-1) | 400 | (A2-1) | 300 | (B-1) | 0.5 | (C-1) | 0.10 | X | 0.065 |
| Comp. Sample 1 | | | (A2-1) | 700 | (B-1) | 0.5 | (C-4) | 0.10 | ○ | * |
| Comp. Sample 2 | | | (A2-1)<br>(A2-2) | 400<br>300 | (B-1) | 0.5 | (C-4) | 0.10 | ○ | * |
| Comp. sample 3 | (A1-1) | 700 | | | (B-4) | 0.5 | (C-4) | 0.10 | X | 0.100 |

Example 2

A series of lubricating compositions were prepared by adding additional components in the formulations and compounded ratios indicated in Tables 2 to 10 to the individual lubricating compositions of the present invention used in Example 1, and were subjected to the tests in a similar manner. Likewise, a series of comparative lubricating compositions were prepared by adding additional components indicated as Formulations 1 to 9 to the comparative lubricating compositions 1 to 3, and were compared. The % by weight for each component is a proportion to the base oil.

TABLE 2

| Formulation 1 | (%) |
|---|---|
| Inventive Sample 1 | |
| Ca salicylate (TBN 190) | 3.0 |
| Boron-modified polybutenyl succinic acid bisimide (average molecular weight 4000) | 3.0 |
| Tetraoctyl thiuram disulfide | 1.0 |
| Glycerol monooleate | 0.2 |
| Benzimidazole | 0.1 |
| Polydimethyl silicone | 0.01 |
| Polymethacrylate | 3.0 |

TABLE 3

| Formulation 2 | (%) |
|---|---|
| Inventive Sample 1 | |
| Ca sulfonate (TBN 300) | 3.0 |
| Boron-modified polybutenyl succinic acid monoimide (average molecular weight 1000) | 3.0 |
| Sulfurized sperm oil | 0.5 |
| Dilauryl thiodipropionate | 0.5 |
| Zinc dioctyldithiocarbamate | 1.0 |

TABLE 3-continued

| Formulation 2 | (%) |
|---|---|
| Benzimidazole | 0.1 |
| Polydimethyl silicone | 0.01 |
| Ethylene-propylene copolymer | 3.0 |

TABLE 4

| Formulation 3 | (%) |
|---|---|
| Inventive Sample 1 | |
| 2,6-Di-t-butylcresol | 0.5 |
| Ca salicylate (TBN 280) | 3.0 |
| Polybutenyl succinic acid bisimide (average molecular weight 4000) | 3.0 |
| Dibenzyl disulfide | 0.5 |
| Dibenzyl monosulfide | 0.5 |
| Copper oleate | 0.5 |
| Lauric acid diethanolamide | 0.1 |
| Benzimidazole | 0.1 |
| Polydimethyl silicone | 0.01 |
| Polymethacrylate | 5.0 |

TABLE 5

| Formulation 4 | (%) |
|---|---|
| Inventive Sample 1 | |
| Ca sulfonate (TBN 28) | 2.0 |
| Ca phenate (TBN 255) | 1.0 |
| Polybutenyl succinic acid bisimide (average molecular weight 1000) | 4.0 |
| 2,5-Di(4,5-dithianonyl)-1,3,4-thiadiazole | 0.5 |
| Sulfurized fish oil | 0.5 |
| Antimony dioctyldithiocarbamate | 0.1 |
| N,N'-Salicylidene-1,2-propanediamine | 1.0 |

TABLE 5-continued

| Formulation 4 | (%) |
|---|---|
| Polydimethyl silicone | 0.01 |
| Ethylene-propylene copolymer | 3.0 |

TABLE 6

| Formulation 5 | (%) |
|---|---|
| Inventive Sample 1 | |
| Ca salicylate (TBN 190) | 2.0 |
| Ca salicylate (TBN 280) | 1.0 |
| Boron-modified polybutenyl succinic acid bisimide (average molecular weight 4000) | 3.0 |
| Sorbitan sesquioleate | 1.0 |
| Benzimidazole | 0.1 |
| Polymethacrylate | 3.0 |

TABLE 7

| Formulation 6 | (%) |
|---|---|
| Inventive Sample 1 | |
| Ca salicylate (TBN 280) | 1.5 |
| Mg salicylate (TBN 400) | 1.5 |
| Boron-modified polybutenyl succinic acid bisimide (average molecular weight 4000) | 3.0 |
| Benzimidazole | 0.1 |
| Polymethacrylate | 3.0 |

TABLE 8

| Formulation 7 | (%) |
|---|---|
| Inventive Sample 1 | |
| Ca sulfonate (TBN 300) | 1.5 |
| Mg sulfonate (TBN 400) | 1.5 |
| Polybutenyl succinic acid monoimide (average molecular weight 2000) | 3.0 |
| Zinc dioctyldithiocarbamate | 1.0 |
| Benzylamine (average molecular weight 1000) | 1.0 |
| Benzimidazole | 0.1 |
| Polydimethyl silicone | 0.01 |
| Ethylene-propylene copolymer | 5.0 |

TABLE 9

| Formulation 8 | (%) |
|---|---|
| Inventive Sample 1 | |
| Dilauryl thiodipropionate | 0.5 |
| Mg sulfonate (TBN 400) | 3.0 |
| Polybutenyl succinic acid bisimide (average molecular weight 4000) | 5.0 |
| Dibenzyl disulfide | 0.5 |
| Oleylamine | 3.0 |
| Benzotriazole | 0.1 |
| Polymethacrylate | 3.0 |

TABLE 10

| Formulation 9 | (%) |
|---|---|
| Inventive Sample 17 | |
| Ca salicylate (TBN 190) | 2.0 |
| Ca salicylate (TBN 280) | 1.0 |
| Boron-modified polybutenyl succinic acid bisimide (average molecular weight 4000) | 3.0 |
| 2,5-Di(4,5-dithianonyl)-1,3,4-thiadiazo1e | 0.5 |
| Benzimidazole | 0.1 |
| Polydimethyl silicone | 0.01 |
| Ethylene-propylene copolymer | 5.0 |

Each of the lubricating compositions having the above formulations was subjected to the tests. As a result, all the inventive samples had a frictional coefficient ranging from 0.055 to 0.070 and showed no precipitate in the low-temperature stability test. On the contrary, each of the comparative samples had a low frictional coefficient or invited precipitation.

What is claimed is:

1. A lubricating composition comprising a lubricating base containing:

Component (A1): an asymmetric sulfurized oxymolybdenum dithiocarbamate represented by the following formula (1)

(1)

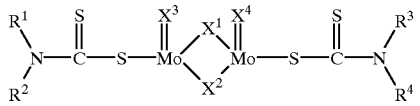

wherein $R^1$ to $R^4$ are each a hydrocarbon group, provided that all of $R^1$ to $R^4$ are not concurrently the same group, and $X^1$ to $X^4$ are each a sulfur atom or an oxygen atom;

Component (A2): a symmetric sulfurized oxymolybdenum dithiocarbamate represented by the following formula (2)

(2)

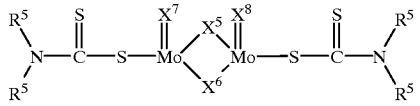

wherein $R^5$ is a hydrocarbon group, $X^5$ to $X^8$ are each a sulfur atom or an oxygen atom, and the ratio by weight of component (A1) to component (A2) is 5/95 to 80/20; and Component (B): a phenolic antioxidant or an aminic antioxidant.

2. A lubricating composition according to claim 1, wherein $R^1$ and $R^2$ are both the same hydrocarbon group, $R^3$ and $R^4$ are both the same hydrocarbon group, and $R^1$ and $R^3$ are both different hydrocarbon groups in formula (1).

3. A lubricating composition according to claim 1, wherein $R^1$ and $R^2$ are each an alkyl group having 6 to 10 carbon atoms, and $R^3$ and $R^4$ are each an alkyl group having 11 to 18 carbon atoms in formula (1).

4. A lubricating composition according to claim 1, further comprising component (c): a zinc dithiophosphate IU represented by the following formula (3)

(3)

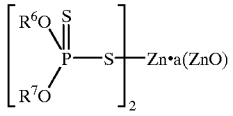

wherein $R^6$ and $R^7$ are each a hydrocarbon group, and a denotes a number from 0 to 1/3.

5. A lubricating composition according to claim 1, further comprising one or more members of the following components (D1) to (D13):

(D1) a metallic detergent;

(D2) an ashless dispersant;

(D3) a compound containing phosphorus atoms;

(D4) a compound containing phosphorus atoms and sulfur atoms;

(D5) a compound containing sulfur atoms and containing no metal atoms;

(D6) a sulfureous antioxidant;

(D7) an organometallic compound;

(D8) an oiliness improver free of any metal atoms, phosphorus atoms and sulfur atoms;

(D9) a rust inhibitor;

(D10) a viscosity index improver;

(D11) a metal deactivator;

(D12) an antifoaming agent;

(D13) a solid lubricant.

* * * * *